US008278227B2

(12) United States Patent
Shibaoka et al.

(10) Patent No.: US 8,278,227 B2
(45) Date of Patent: Oct. 2, 2012

(54) POLYESTER WOVEN FABRIC

(75) Inventors: Hiroshi Shibaoka, Hikone (JP); Sunao Takahira, Takarazuka (JP)

(73) Assignee: KB Seiren, Ltd., Fukui (JP)

( * ) Notice: Subject to any disclaimer, the term of this patent is extended or adjusted under 35 U.S.C. 154(b) by 958 days.

(21) Appl. No.: 10/594,733

(22) PCT Filed: Mar. 30, 2005

(86) PCT No.: PCT/JP2005/006065

§ 371 (c)(1),
(2), (4) Date: Apr. 5, 2007

(87) PCT Pub. No.: WO2005/095690

PCT Pub. Date: Oct. 13, 2005

(65) Prior Publication Data

US 2007/0202763 A1 Aug. 30, 2007

(30) Foreign Application Priority Data

Mar. 31, 2004 (JP) ..... 2004-107407

(51) Int. Cl.
*D03D 11/00* (2006.01)
*D03D 23/00* (2006.01)
*A47G 9/08* (2006.01)

(52) U.S. Cl. ..... 442/203; 2/69.5; 5/413 R; 139/383 R; 139/420 A

(58) Field of Classification Search ..... 442/181–303; 5/413 R; 2/69.5
See application file for complete search history.

(56) References Cited

U.S. PATENT DOCUMENTS

| | | | | |
|---|---|---|---|---|
| 3,071,783 | A * | 1/1963 | Gamble | 5/636 |
| 4,582,747 | A * | 4/1986 | Hirakawa et al. | 442/189 |
| 5,273,813 | A * | 12/1993 | Akamatsu et al. | 442/203 |
| 5,466,514 | A | 11/1995 | Kataoka et al. | |
| 6,277,770 | B1 * | 8/2001 | Smith et al. | 442/190 |
| 6,824,819 | B2 * | 11/2004 | Vogt et al. | 427/203 |
| 2002/0111099 | A1 | 8/2002 | Howland | |
| 2006/0084337 | A1 * | 4/2006 | Corner et al. | 442/203 |
| 2006/0183390 | A1 * | 8/2006 | Fukunishi et al. | 442/181 |

FOREIGN PATENT DOCUMENTS

| | | | |
|---|---|---|---|
| JP | 2002-309463 | A | 10/2002 |
| JP | 2003-138446 | * | 5/2003 |
| JP | 2003-138446 | A | 5/2003 |
| JP | 2003-138449 | A | 5/2003 |
| JP | 2003-328246 | A | 11/2003 |
| JP | 2004-44018 | A | 2/2004 |
| JP | 2004-52191 | A | 2/2004 |
| JP | 2004-60064 | A | 2/2004 |
| JP | 2004-162194 | A | 6/2004 |
| JP | 2005-048298 | * | 2/2005 |
| TW | 200402488 | A | 2/2004 |
| WO | WO-94/21848 | A1 | 9/1994 |

* cited by examiner

*Primary Examiner* — Jennifer A Steele
(74) *Attorney, Agent, or Firm* — Denison, Schultz & MacDonald

(57) ABSTRACT

A polyester fabric having a total cover factor of not lower than 1500 and a mass per unit area of not higher than 45 g/m$^2$, wherein said polyester fabric is composed of polyester multifilament A yarns having a total fineness of not higher than 25 dtex (decitex) and a single yarn fineness of not higher than 2.0 dtex and multifilament B yarns having a total fineness of not lower than 35 dtex, wherein the arrangements of the respective yarns in the warp and weft directions are such that the yarn constitution ratio "B yarn/A yarn" is ¼ to 1/20 (number of yarns-to-number of yarns ratio) and wherein the A yarn-to-B yarn pitches are not longer than 7 mm.

The polyester fabric is light in weight, high in density and flexible by using extra-fine polyester multifilaments finer as compared with the conventional polyester multifilaments and, at the same time, has a sufficient level of tear strength.

10 Claims, No Drawings

POLYESTER WOVEN FABRIC

This application is a National Stage of PCT/JP2005/006065 filed Mar. 30, 2005 which in turn claims priority from Japanese Application 2004-107407, filed Mar. 31, 2004.

TECHNICAL FIELD

The present invention relates to a polyester fabric as well as an umbrella cloth, a downproof fabric and a warmth retaining material, each made by using the polyester fabric.

BACKGROUND ART

Fabrics made of polyester multifilaments are in wide use as various cloth materials for sportswear, casual wear, coats and the like or as clothes such as downproof fabrics, and umbrella cloths. So far, polyester multifilaments having a thickness of about 56 dtex/48 f have been used as such polyester multifilaments. In recent years, however, lightweight polyester fabrics lighter in weight, higher in density and flexible have been demanded in various fields of application.

In the case of downproof fabrics to be used in down jackets or as bedclothes, for instance, polyester fabrics light in weight, high in density and flexible are desired so that high levels of warmth retention may be obtained. The use of such polyester fabrics makes it possible to obtain warmth retaining materials low in air permeability and excellent in warmth retention. Furthermore, since the resulting fabrics are flexible, cotton, down and the like, which are used in down jackets, bedclothes and so forth as warmth retaining mass, will not be excessively compressed by the downproof fabrics; hence, the air retention rate can be increased. Owing to such effects, still better warmth retention can be attained.

Further, in the field of umbrella cloths, fabrics high in density, excellent in waterproofness and, at the same time, excellent in portability are desired. When polyester fabrics light in weight, high in density and flexible are used, umbrellas excellent in portability can be obtained because the cloths are high in density and thin and therefore are reduced in volume and the umbrellas can be reduced in volume upon folding. The conventional folding umbrellas have a problem, namely the umbrella cloth is poor in flexibility, the folding parts tend to hold air excessively and, unless folded along the folding lines provided in advance, the umbrellas cannot be sufficiently reduced in volume and, as a result, time and effort are required for folding them.

In addition, in the fields of tent cloths, casual wear, coats and the like, the use of polyester fabrics light in weight, high in density and excellent in flexibility is preferred since such favorable characteristics as portability, warmth retention, lightness in weight, and feel and touch can also be then obtained.

A known method of rendering cloths lightweight comprises using hollow fibers, for instance (Japanese Kokai Publication 2002-309463). However, although they are lightweight, such hollow fibers have problems, namely they are unsatisfactory in thinness and lacking in portability and compactness. In addition, hollow fibers are weaker in tear strength as compared with ordinary fibers on the same fineness level.

As another method of rendering cloths lightweight, there may be mentioned the method which uses extra-fine polyester multifilaments which are finer than the conventional polyester multifilaments. However, fabrics made of extra-fine polyester multifilaments are insufficient in tear strength and therefore cannot have those performance characteristics which make fabrics suited for use in the above-mentioned various fields of application. Further, the difficulty in obtaining flexibility is another problem.

DISCLOSURE OF INVENTION

Problems Which the Invention is to Solve

In view of the foregoing, it is an object of the present invention to provide a polyester fabric which is light in weight, high in density and flexible and, at the same time, has a sufficient level of tear strength, by using extra-fine polyester multifilaments finer as compared with the conventional polyester multifilaments.

Means for Solving the Problems

The present invention relates to a polyester fabric having a total cover factor of not lower than 1500 and a mass per unit area of not higher than 45 g/m$^2$, wherein said polyester fabric is composed of polyester multifilament A yarns having a total fineness of not higher than 25 dtex (decitex) and a single yarn fineness of not higher than 2.0 dtex and multifilament B yarns having a total fineness of not lower than 35 dtex, wherein the arrangements of the respective yarns in the warp and weft directions are such that the yarn constitution ratio "B yarn/A yarn" is ¼ to 1/20 (number of yarns-to-number of yarns ratio) and wherein the A yarn-to-B yarn pitches are not longer than 7 mm.

The B yarns are preferably paralleled yarns.

The polyester fabric is preferably a calendered one and has a tear strength of not lower than 7 N in each of the warp and weft directions and an air permeability of not higher than 1.2 cc/cm$^2$/sec.

The present invention also relates to an umbrella cloth comprising the polyester fabric mentioned above.

The present invention also relates to a downproof fabric comprising the polyester fabric mentioned above.

The present invention also relates to a warmth retaining material which comprises a bag-like body made of a downproof fabric comprising the polyester fabric mentioned above and a warmth retaining mass packed in said bag-like body.

In the following, the present invention is described in detail.

The polyester fabric of the invention is a fabric made by using extra-fine polyester multifilament A yarns (hereinafter referred to as "A yarns" for short) and multifilament B yarns (hereinafter referred to as "B yarns" for short) having a total fineness of not lower than 35 dtex, and is a fabric light in weight, high in density and excellent in flexibility and, further, excellent in tear strength. Since it is light in weight and high in density, the polyester fabric can be one reduced in thickness.

The invention provides a polyester fabric having such properties that render the same suited for the purposes mentioned above, by attaining a reduction in weight and an increase in density through the use of extra-fine polyester multifilament A yarns and, at the same time, using, in a certain proportion, multifilament B yarns having a total fineness of not lower than 35 dtex to thereby improve such physical properties as tear strength.

In the practice of the present invention, the above-mentioned A yarns have a total fineness of not higher than 25 dtex and a single-yarn fineness of not higher than 2.0 dtex. So long as the total fineness and single yarn fineness are within the respective ranges mentioned above, the number of filaments constituting each A yarn is not particularly restricted but preferably about 10 to 30.

When the single yarn fineness of the A yarns exceeds 2.0 dtex, the fabric becomes lacking in flexibility and the desired high-density polyester fabric can never be obtained. Preferably, the single yarn fineness is not higher than 1.3 dtex. When the total fineness of the A yarns exceeds 25 dtex, the polyester fabric obtained becomes increased in thickness, hence weight reduction becomes difficult. The total fineness is preferably not higher than 23 dtex.

The method of producing the A yarns is not particularly restricted but may be any of the methods known in the art, including, among others, the method comprising melt spinning polyester chips prepared by polycondensation of ethylene glycol with terephthalic acid under reduced pressure at an elevated temperature, followed by taking up and stretching. Since the polyester multifilaments A to be used in the practice of the invention have a single yarn fineness of not higher than 2.0 dtex, care is preferably taken in selecting production conditions; for example, the tension during taking up and stretching should be lower than usual.

The polyester filaments A may be round or modified in cross-section.

The polyester fabric of the invention comprises not only the A yarns but also the B yarns, which are multifilaments having a total fineness of not lower than 35 dtex, in the yarn arrangements in both the warp and weft directions. The fact that the B yarns are contained in both the warp and weft arrangements makes it possible to improve the weavability of the A yarns, which are extra-fine polyester multifilaments, and the tear strength of the product fabric.

The filaments constituting the B yarns are not particularly restricted in fiber species but preferably are synthetic fibers such as polyester multifilaments or polyamide multifilaments. Among them, polyester multifilaments almost equal in such physical properties as shrinkage percentage to the A yarns are most preferred since the use thereof can lead to reduced surface irregularities of the product polyester fabric. More specifically, the difference in shrinkage percentage is preferably not greater than 5%. So long as the B yarns have a total fineness of not lower than 35 dtex, the fineness of the constituent single yarns is not particularly restricted but preferably is 40 to 60 dtex. The B yarns may have a round cross-section or a modified cross-section, for example a triangular or flattened cross-section, and they may be bright yarns, semi-dull yarns or fully dull yarns. The B yarns may be electrically conductive yarns, for example conductive yarns containing a conductive component such as carbon black or a white conductive component in the fibers or conductive yarns having a metal plating layer on the fiber surface.

The B yarns are not particularly restricted but may be single yarns, preferably paralleled yarns such as double yarns, triple yarns or quadruple yarns. By using such paralleled yarns, it becomes possible to further increase the tear strength of the polyester fabric of the invention.

The B yarn/A yarn constitution ratio in the polyester fabric of the invention is ¼ to 1/20 (number of yarns-to-number of yarns ratio). When the share of the B yarns in the yarn constitution is excessively large, such objects of the invention as reductions in weight and thickness cannot be accomplished to a satisfactory extent. Conversely, when the share of the A yarns in the yarn constitution is excessively large, no satisfactory tear strength can be obtained. The yarn constitution ratio is preferably ¼ to 1/15 (number of yarns-to-number of yarns ratio). This yarn constitution ratio is to be applied to the constitution ratio in the warp constitution as well as to that in the weft constitution. Thus, it is meant that the B yarn/A yarn constitution ratios in the warp and weft constitutions are respectively within the range of ¼ to 1/20 (number of yarns-to-number of yarns ratio).

The A yarn-to-B yarn pitch in the polyester fabric of the invention is not longer than 7 mm. When the above-mentioned pitch is longer than 7 mm, the effect of the combined use of the B yarns may possibly be not produced. The above pitch is preferably not longer than 3.5 mm. Like the yarn constitution ratio, the above-mentioned pitch value is applicable to both the B yarn/A yarn pitches in the warp and weft constitutions; it is thus meant that the pitches in the warp and weft directions each is not longer than 7 mm.

In arranging the A yarns and B yarns, respectively, the arrangement may be an arrangement resulting from repetitions of the same constituent unit or may be a random arrangement provided that the above-mentioned yarn constitution ratio and pitch requirements are satisfied. As for the repeating constituent unit, the constituent unit may consist of m A yarns and n B yarns, for instance, and may be repeated so that the A yarns and B yarns may be arranged always at regular intervals; or, m A yarns, n B yarns, o A yarns and p B yarns may constitute one constituent unit and this constituent unit may be arranged in a repeated manner (m, n, o and p each being an integer not smaller than 1). It is also possible to employ an appropriate arrangement as desired so as to give an appearance rich in beauty and design according to the intended use of the fabric.

The polyester fabric of the invention has a total cover factor of not lower than 1500. Since it is a high-density fabric with a total cover factor of not lower than 1500, it is a fabric low in air permeability, good in feeling and excellent in downproofness. When the total cover factor is lower than 1500, interstitial spaces cannot be filled up to a sufficient extent, so that the feeling and downproofness unfavorably become poor. The upper limit to the total cover factor is not particularly restricted but preferably is 2000, more preferably 1950, most preferably 1900. The total cover factor is more preferably not lower than 1600. The total cover factor so referred to herein is the sum of the cover factor (CF) in the warp direction and that in the weft direction. The cover factors in the warp and weft directions each can be represented by the equation:

$$CF=(\text{segment fineness})^{1/2}\times(\text{number of segment yarns}/2.5\text{ cm}).$$

The polyester fabric mentioned above is a lightweight polyester fabric having weight of not higher than 45 g/m$^2$. Thus, owing to its having the constitution described above, the polyester fabric can be excellent in tear strength in spite of its being a lightweight fabric with weight of not higher than 45 g/m$^2$. At weight levels exceeding 45 g/m$^2$, the portability and compactness, among others, become inferior. The weight is preferably not higher than 40 g/m$^2$.

The polyester fabric of the invention is also a preferred one since the thickness thereof can be reduced to 0.065 mm or below. Thus, it can be such a thin fabric that can never have been obtained by the technique of reduction in weight using hollow fibers; accordingly, it can be a fabric excellent in portability and compactness.

The weave of the above-mentioned polyester fabric is not particularly restricted but may be any arbitrary weave known in the art. As the weave, there may be mentioned, for example, plain weave and weaves derived therefrom, twill weave and weaves derived therefrom.

The polyester fabric of the invention preferably has a tear strength of not lower than 7 N. When the tear strength is lower than 7 N, there is the possibility that no sufficient strength can be retained. The tear strength is measured according to JIS L 1096 8.15.5 Method D (pendulum method). The tear strength is more preferably not lower than 9 N. While the measured tear strength in the warp direction and that in the weft direction generally differ from each other, it is more preferable that the tear strength in each direction be not lower than 7 N.

The polyester fabric of the invention may be one submitted to one or more of such conventional after-treatment steps as scouring, calendering, waterproofing, air impermeability imparting and dyeing steps. In carrying out these steps, the treatment conditions, treatment methods and other factors are as in the conventional art.

The fabric is preferably one subjected to calendering treatment among the treatments mentioned above. The calendering treatment of the polyester fabric results in filling of interstitial spaces of the fabric, hence in increased waterproofness and warmth retention, among others. The polyester fabric subjected to calendering treatment can be suitably used as an umbrella cloth or a downproof fabric, for instance.

The set conditions in the above calendering process, such as the traveling speed, heating roll load and heating roll surface temperature, are matters requiring adjustment according to the state of distribution of the polyester multifilaments on the weave structure, the shape and physical properties of the polyester multifilaments and the requirements imposed on the desired fabric, among others. To take an example, the traveling speed is preferably about 20 to 30 m/minute, the heating roll load is preferably 25 to 60 tons, and the heating roll surface temperature is preferably around 180° C. Prior to the calendering treatment mentioned above, scouring and presetting may be carried out successively in the conventional manner.

When the polyester fabric is subjected to calendering, the polyester fabric after treatment preferably has a tear strength of not lower than 7 N, more preferably not lower than 9 N. The polyester fabric after calendering preferably has an air permeability of not higher than 1.2 cc/cm$^2$/sec. The air permeability is measured according to JIS L 1096 (Frajour type method). When it is low in air permeability, the polyester fabric can acquire excellent warmth retention, downproofness and waterproofness. In cases where the above-mentioned calendering is carried out, the treatment is preferably carried out through the steps of scouring→heat setting→dyeing→finishing→calendering since, then, the polyester fabric, which has the desired physical properties, can be obtained with ease.

An umbrella cloth comprising the above-mentioned polyester fabric also constitutes an aspect of the invention. Since the polyester fabric mentioned above is light in weight and high in density and can have a reduced thickness, as described hereinabove, the fabric is excellent in such features as waterproofness and compactness that are required of the umbrella cloth. Further, since it is excellent in flexibility as well, the holding of air by the cloth on the occasion of folding can be suppressed and the volume thus can be reduced, so that umbrellas excellent in portability can be obtained.

A downproof fabric comprising the above-mentioned polyester fabric constitutes another aspect of the present invention. Since the polyester fabric is high in density, so that it has a high level of airtightness. Therefore, a warmth retaining material comprising the above-mentioned downproof fabric is highly capable of retaining warmth. Since the downproof fabric is light in weight and can be made thin and flexible, the warmth retaining mass, such as cotton or down, enclosed by that fabric will not be excessively compressed by that fabric. Thus, it is possible to pack the warmth retaining mass with plenty of air held thereby. Accordingly, the warmth retaining material obtained can be one improved in warmth retaining function and, at the same time, reduced in weight.

The present invention is also directed to a bag-like body at least partly made of the downproof fabric comprising the above-mentioned polyester fabric and to a warmth retaining material comprising the above-mentioned bag-like body and a warmth retaining mass packed therein. The warmth retaining material of the invention includes, among others, bedclothes, for example bedding and pillows; and clothes such as down jackets. The warmth retaining material mentioned above has excellent properties, namely it is excellent in warmth retention and is lightweight.

The bag-like body at least partly made of the polyester fabric may be one obtained by wholly using the polyester fabric mentioned above or one obtained by using another fabric in part in combination with the polyester fabric. Usable as the warmth retaining mass mentioned above are those warmth retaining masses which are generally used in warmth retaining materials, for example, natural fiber cottons such as cotton wool; chemical or synthetic fiber cottons such as ester cotton; feathers and down. The above-mentioned warmth retaining material can be produced in the conventional manner.

In addition, the above-mentioned polyester fabric can also be used as a tent cloth, as a material for casual wear, coats and the like, and as a lining cloth, for instance.

Effects of the Invention

The polyester fabric of the invention, which comprises extra-fine polyester multifilaments, can attain lightness in weight and a high level of density and is a fabric excellent in warmth retention, waterproofness, compactness and downproofness. Further, the polyester fabric of the invention can have an excellent tear strength, which can have never been attained by the use of extra-fine polyester multifilaments alone, by using B yarns having a total fineness of not lower than 35 dtex. The use of such B yarns makes it possible to weave extra-fine polyester multifilaments efficiently.

BEST MODES FOR CARRYING OUT THE INVENTION

The following examples illustrate the present invention in further detail. These examples are, however, by no means limitative of the scope of the invention.

Example 1

A rip-stop taffeta fabric was produced using 22/12 polyester multifilaments (product of Kanebo Gohsen) as A warp yarns, double yarns each consisting of two paralleled 22/12 polyester multifilaments (product of Kanebo Gohsen) as B warp yarns, 22/24 polyester multifilaments (product of Kanebo Gohsen) as A weft yarns and 44/18 polyester multifilaments (product of Kanebo Gohsen) as B weft yarns; the A warp yarn-to-B warp yarn number ratio was 12:1 and the A weft yarn-to-B weft yarn number ratio was 11:1. The fabric obtained was subjected to scouring, heat setting (190° C.), dyeing (130° C.) and finishing (160° C.) and then to calendering under the following conditions: 190° C., heating roll load 27 tons, and traveling speed 25 m. The total cover factor, air permeability, tear strength, weight, A yarn-to-B yarn pitches and thickness, among others, of the fabric obtained were measured; the data obtained are shown in Table 3. The A yarns and B yarns used respectively had the fineness and shapes shown in Table 1.

Examples 2 to 11 and Comparative Examples 1 to 15

Fabrics were prepared and evaluated in the same manner as in Example 1 except that the A yarn and B yarn species used and the yarn constitution ratios were changed as shown in Table 2. The results are shown in Table 3.

Example 12

A double rip taffeta fabric was produced using 22/12 polyester multifilaments (product of Kanebo Gohsen) as A warp yarns, double yarns each consisting of two paralleled 22/12 polyester multifilaments (product of Kanebo Gohsen) as B warp yarns, 22/24 polyester multifilaments (product of Kanebo Gohsen) as A weft yarns and 56/24 polyester multifilaments (product of Kanebo Gohsen) as B weft yarns; the A warp yarn-to-B warp yarn number ratio was 16:2 and the A weft yarn-to-B weft yarn number ratio was 20:2. The yarn arrangement in the warp direction was such that a unit composed of 14 A yarns, 1 B yarn, 2 A yarns and 1 B yarn was repeated one after another, and the yarn arrangement in the weft direction was such that a unit composed of 18 A yarns, 1 B yarn, 2 A yarns and 1 B yarn was repeated one after another. The fabric obtained was subjected to scouring, heat setting (190° C.), dyeing (130° C.) and finishing (160° C.) and then to calendering under the following conditions: 190° C., heating roll load 27 tons, and traveling speed 25 m. The total cover factor, air permeability, tear strength, weight, A yarn/B yarn pitches and thickness, among others, of the fabric obtained were measured; the data obtained are shown in Table 3. The A yarns and B yarns used respectively had the fineness and shapes shown in Table 1. The fabric obtained was rich in changes in design with the rip-stop lines forming a pair of lines.

Further, the downproofness, softness, down opening tendency and compactness of the fabric obtained were evaluated by the methods described below. The results are shown in Table 3.

Downproofness

Two 12-cm-square pieces of the fabric were put together, 1 g of down was packed therebetween to form a 10-cm square, and the two pieces were sewn together. The assembly was then manually folded in two, and the downproofness was evaluated as follows:

Zero or one feather seen on the fabric surface: ○;
Two to five feathers: Δ;
Six or more feathers: X.

Softness

The evaluation was made according to JIS L 1096 Bending resistance testing 6.19.4 Method D (heart loop method). The criteria were as follows:

○: 70 mm or more (soft);
X: 60 mm or more but less than 70 mm (firm and rigid);
X X: less than 60 mm (very rigid).

Down Opening Tendency

Two 12-cm-square pieces of the fabric were put together, 1 g of down was packed therebetween to form a 10-cm square, and the two pieces were sewn together. The maximum thickness on that occasion was measured.

Not thinner than 30 mm: ○;
Not thinner than 25 mm but thinner than 30 mm: X;
Thinner than 25 mm: X X Compactness A 16 cm×16 cm piece of the fabric was repeatedly folded in four to form an about 2-cm square, a 4-g weight was placed thereon, and the thickness on that occasion was measured.

○: thinner than 4 mm;
X: not thinner than 4 mm;
X X: not thinner than 6 mm.

TABLE 1

| | Fineness (dtex/f) | Product name of yarn species used | Single yarn fineness (dtex) | Kind of yarn |
|---|---|---|---|---|
| Warps | 22/12 | 22 T/12-BTD | 1.8 | 22 dtex/12 f bright yarns, Δ in cross-section |

TABLE 1-continued

| | Fineness (dtex/f) | Product name of yarn species used | Single yarn fineness (dtex) | Kind of yarn |
|---|---|---|---|---|
| | 33/36 | 33 T/36-BTD | 0.9 | 33 dtex/36 f bright yarns, Δ in cross-section |
| | 22/6 | 22 T/6-BTD | 3.6 | 22 dtex/6 f bright yarns, Δ in cross-section |
| | 17/12 | 17 T/12-BTD | 1.4 | 17 dtex/12 f bright yarns, Δ in cross-section |
| | 22/12/2 | — | — | Two paralleled 22 T/12-BTD yarns |
| | 17/12/3 | — | — | Three paralleled 17 T/12-BTD yarns |
| | 17/12/2 | — | — | Two paralleled 17 T/12-BTD yarns |
| | 33/36/2 | — | — | Two paralleled 33 T/36-BTD yarns |
| Wefts | 22/24 | 22 T/24-DND | 0.9 | 22 dtex/24 f fully dull yarns, ○ in cross-section |
| | 17/12 | 17 T/12-BTD | 1.4 | 17 dtex/12 f bright yarns, Δ in cross-section |
| | 44/18 | 44 T/18-DND | 2.4 | 22 dtex/24 f fully dull yarns, ○ in cross-section |
| | 56/24 | 56 T/24-DND | 2.3 | 56 dtex/24 f fully dull yarns, ○ in cross-section |
| | 44/48 | 44 T/48-DND | 0.9 | 44 dtex/48 f fully dull yarns, ○ in cross-section |
| | 84/36 | 84 T/36-DND | 2.3 | 84 dtex/36 f fully dull yarns, ○ in cross-section |

TABLE 2

| | Warps | | | | | | | Wefts | | | | | | |
|---|---|---|---|---|---|---|---|---|---|---|---|---|---|---|
| | A yarn fineness (dtex/f) | A yarn single yarn fineness (dtex) | B yarns (dtex/f/ number of yarns | B yarn total fineness (dtex) | A:B | Density (number of yarns/ 2.5 cm) | Average fineness (dtex) | A yarn fineness (dtex/f) | A yarn single yarn fineness (dtex) | B yarns (dtex/f) | B yarn total fineness (dtex) | A:B | Density (number of yarns/ 2.5 cm) | Average fineness (dtex) |
| Example 1 | 22/12 | 1.8 | 22/12/2 | 44.4 | 12:1 | 206 | 23.93 | 22/24 | 0.9 | 44/18 | 44.4 | 11:1 | 178 | 24.05 |
| Comparative Example 1 | 22/12 | 1.8 | 22/12/2 | 44.4 | 3:1 | 190 | 27.75 | 22/24 | 0.9 | 44/18 | 44.4 | 11:1 | 178 | 24.05 |
| Example 2 | 22/12 | 1.8 | 22/12/2 | 44.4 | 4:1 | 194 | 26.64 | 22/24 | 0.9 | 44/18 | 44.4 | 11:1 | 178 | 24.05 |
| Example 3 | 22/12 | 1.8 | 22/12/2 | 44.4 | 6:1 | 199 | 25.37 | 22/24 | 0.9 | 44/18 | 44.4 | 11:1 | 178 | 24.05 |
| Example 4 | 22/12 | 1.8 | 22/12/2 | 44.4 | 10:1 | 204 | 24.22 | 22/24 | 0.9 | 44/18 | 44.4 | 11:1 | 178 | 24.05 |
| Example 5 | 22/12 | 1.8 | 22/12/2 | 44.4 | 15:1 | 206 | 23.59 | 22/24 | 0.9 | 44/18 | 44.4 | 11:1 | 178 | 24.05 |
| Example 6 | 22/12 | 1.8 | 22/12/2 | 44.4 | 20:1 | 208 | 23.26 | 22/24 | 0.9 | 44/18 | 44.4 | 11:1 | 178 | 24.05 |
| Comparative Example 2 | 22/12 | 1.8 | 22/12/2 | 44.4 | 22:1 | 208 | 23.17 | 22/24 | 0.9 | 44/18 | 44.4 | 11:1 | 178 | 24.05 |
| Compartive Example 3 | 22/12 | 1.8 | 22/12/2 | 44.4 | 15:1 | 162 | 23.59 | 22/24 | 0.9 | 44/18 | 44.4 | 11:1 | 145 | 24.05 |
| Comparative Example 4 | 22/12 | 1.8 | 22/12/2 | 44.4 | 5:1 | 220 | 25.90 | 22/24 | 0.9 | 44/18 | 44.4 | 5:1 | 197 | 25.90 |
| Comparative Example 5 | 33/36 | 0.9 | 22/12/2 | 44.4 | 12:1 | 202 | 34.15 | 22/24 | 0.9 | 44/18 | 44.4 | 11:1 | 178 | 24.05 |
| Comparative Example 6 | 22/6 | 3.6 | 22/12/2 | 44.4 | 12:1 | 205 | 23.91 | 22/24 | 0.9 | 44/18 | 44.4 | 11:1 | 178 | 24.05 |
| Comparative Example 7 | 22/12 | 1.8 | 22/12/1 | 22.2 | 12:1 | 206 | 22.20 | 22/24 | 0.9 | 44/18 | 44.4 | 11:1 | 178 | 24.05 |
| Comparative Example 8 | 22/12 | 1.8 | 22/12/2 | 44.4 | 48.3 | 176 | 23.51 | 22/24 | 0.9 | 44/18 | 44.4 | 11:1 | 154 | 24.05 |
| Example 7 | 22/12 | 1.8 | 22/12/2 | 44.4 | 5:1 | 205 | 25.92 | 22/24 | 0.9 | 44/18 | 44.4 | 5:1 | 174 | 25.90 |
| Example 8 | 17/12 | 1.4 | 17/12/3 | 50.0 | 14:2 | 234 | 20.83 | 17/12 | 1.4 | 56/24 | 55.6 | 10:1 | 183 | 20.24 |
| Example 9 | 17/12 | 1.4 | 17/12/3 | 50.0 | 9:1 | 234 | 20.00 | 17/12 | 1.4 | 56/24 | 55.6 | 6:1 | 187 | 22.26 |
| Example 10 | 22/12 | 1.8 | 22/12/2 | 44.4 | 16:2 | 202 | 24.69 | 22/24 | 0.9 | 56/24 | 55.6 | 10:1 | 170 | 25.24 |
| Example 11 | 22/12 | 1.8 | 22/12/2 | 44.4 | 16:2 | 204 | 24.67 | 22/24 | 0.9 | 44/18 | 44.4 | 5:1 | 173 | 24.67 |
| Comparative Example 10 | 17/12 | 1.4 | 17/12/2 | 33.4 | 7:1 | 235 | 18.76 | 17/12 | 1.4 | 44/48 | 44.4 | 7:1 | 187 | 20.16 |
| Comparative Example 11 | 17/12 | 1.4 | 17/12/2 | 33.4 | 12:2 | 235 | 19.06 | 17/12 | 1.4 | 44/48 | 44.4 | 10:1 | 186 | 19.22 |
| Comparative Example 12 | 17/12 | 1.4 | 17/12/2 | 33.4 | 5:1 | 235 | 19.46 | 17/12 | 1.4 | 44/48 | 44.4 | 5:1 | 181 | 21.32 |
| Comparative Example 13 | 22/12 | 1.8 | 22/12/2 | 44.4 | 11:1 | 204 | 24.07 | 22/24 | 0.9 | 44/48 | 44.4 | 1:1 | 149 | 33.30 |
| Comparative Example 14 | 22/12 | 1.8 | 22/12/2 | 44.4 | 5:1 | 204 | 25.92 | 22/24 | 0.9 | 44/18 | 44.4 | 1:1 | 151 | 33.30 |
| Comparative Example 15 | 33/36 | 0.9 | 33/36/2 | 66.6 | 17:1 | 178 | 35.18 | 22/24 | 0.9 | 84/36 | 83.3 | 14:1 | 153 | 36.63 |
| Example 12 | 22/12 | 1.8 | 22/12/2 | 44.4 | 16:2 | 200 | 24.69 | 22/24 | 0.9 | 56/24 | 55.6 | 20:2 | 170 | 25.09 |

TABLE 3

| | Total cover factor | Air permeability cc/cm$^2$/sec) | Tear strength: Warp direction (N) | Tear strength: Weft direction (N) | Weight g/m$^2$ | Pitch (mm): Warp direction | Pitch (mm): Weft direction | Thickness (mm) | Down-proofness | Softness: length L (mm) | Softness: Softness | Down opening tendency: Opening tendency | Down opening tendency: Thickness (mm) | Compactness | Compactness: Thickness (mm) |
|---|---|---|---|---|---|---|---|---|---|---|---|---|---|---|---|
| Example 1 | 1881 | 1 | 8.6 | 8.6 | 39.4 | 1.6 | 1.7 | 0.06 | ○ | 74 | ○ | ○ | 31 | ○ | 3.4 |
| Comparative Example 1 | 1874 | 0.9 | 9.2 | 8.6 | 40.9 | 0.5 | 1.7 | 0.06 | ○ | 69 | x | x | 29 | x | 4.3 |
| Example 2 | 1874 | 1.0 | 9 | 8.6 | 40.4 | 0.7 | 1.7 | 0.06 | ○ | 73 | ○ | ○ | 31 | ○ | 3.3 |
| Example 3 | 1875 | 1.0 | 8.8 | 8.6 | 39.9 | 0.9 | 1.7 | 0.06 | ○ | 75 | ○ | ○ | 32 | ○ | 3.0 |
| Example 4 | 1877 | 1.0 | 8.6 | 8.6 | 39.5 | 1.4 | 1.7 | 0.06 | ○ | 75 | ○ | ○ | 32 | ○ | 3.0 |
| Example 5 | 1873 | 1.0 | 8.6 | 8.5 | 39.1 | 2.0 | 1.7 | 0.06 | ○ | 73 | ○ | ○ | 31 | ○ | 3.3 |
| Example 6 | 1876 | 1.0 | 7.5 | 8.2 | 39.0 | 2.6 | 1.7 | 0.06 | ○ | 76 | ○ | ○ | 32 | ○ | 2.8 |
| Comparative Example 2 | 1874 | 1.1 | 6.9 | 7.6 | 38.9 | 2.8 | 1.7 | 0.06 | ○ | 72 | ○ | ○ | 31 | ○ | 3.5 |
| Comparative Example 3 | 1498 | 1.5 | 6.9 | 6.8 | 31.3 | 2.5 | 2.1 | 0.06 | x | 83 | ○ | ○ | 35 | ○ | 2.5 |
| Comparative Example 4 | 2122 | 0.7 | 9.8 | 10.3 | 46.2 | 0.7 | 0.8 | 0.07 | ○ | 62 | x | x | 28 | x | 5.2 |
| Comparative Example 5 | 2053 | 0.8 | 12.0 | 8.6 | 47.8 | 1.6 | 1.7 | 0.06 | ○ | 59 | x | x | 27 | x | 5.7 |
| Comparative Example 6 | 1875 | 1.3 | 8.6 | 8.6 | 39.3 | 1.6 | 1.7 | 0.06 | x | 69 | x | ○ | 31 | x | 5.2 |
| Comparative Example 7 | 1844 | 1.2 | 6.8 | 7.6 | 37.9 | 1.6 | 1.7 | 0.06 | Δ | 74 | ○ | ○ | 32 | ○ | 3.2 |
| Comparative Example 8 | 1809 | 0.9 | 6.5 | 6.9 | 33.5 | 7.4 | 2.0 | 0.06 | ○ | 83 | ○ | ○ | 35 | ○ | 2.3 |
| Example 7 | 1929 | 0.9 | 9.4 | 9.4 | 42.0 | 0.7 | 0.9 | 0.06 | ○ | 71 | ○ | ○ | 31 | ○ | 3.7 |
| Example 8 | 1891 | 0.7 | 13 | 10.8 | 36.7 | 1.7 | 1.5 | 0.05 | ○ | 76 | ○ | ○ | 32 | ○ | 3.0 |
| Example 9 | 1929 | 0.6 | 10.3 | 11.6 | 37.8 | 1.1 | 1.0 | 0.05 | ○ | 79 | ○ | ○ | 33 | ○ | 2.5 |
| Example 10 | 1858 | 0.6 | 12.7 | 12.7 | 39.7 | 2.3 | 1.6 | 0.06 | ○ | 72 | ○ | ○ | 31 | ○ | 3.5 |
| Example 11 | 1873 | 0.9 | 9.1 | 7.4 | 39.8 | 2.2 | 1.3 | 0.06 | ○ | 70 | ○ | ○ | 31 | ○ | 3.8 |
| Comparative Example 10 | 1857 | 0.8 | 6.5 | 9.4 | 35.0 | 0.9 | 1.1 | 0.05 | ○ | 80 | ○ | ○ | 34 | ○ | 2.6 |
| Comparative Example 11 | 1841 | 0.5 | 5.9 | 8.6 | 34.5 | 1.5 | 1.5 | 0.05 | ○ | 81 | ○ | ○ | 34 | ○ | 2.4 |
| Comparative Example 12 | 1872 | 0.6 | 5.9 | 9 | 36.1 | 0.6 | 0.6 | 0.05 | ○ | 78 | ○ | ○ | 33 | ○ | 2.8 |
| Comparative Example 13 | 1861 | 1.5 | 8.6 | 11.5 | 42.2 | 1.5 | 0.3 | 0.06 | Δ | 66 | x | x | 29 | x | 4.4 |
| Comparative Example 14 | 1910 | 1.3 | 10 | 9.6 | 44.1 | 0.7 | 0.3 | 0.06 | Δ | 63 | x | x | 28 | x | 4.9 |
| Comparative Example 15 | 1982 | 0.9 | 11.5 | 13.4 | 50.8 | 2.6 | 2.5 | 0.07 | ○ | 55 | xx | xx | 24 | xx | 6.3 |
| Example 12 | 1845 | 1.1 | 9.2 | 8.9 | 41.6 | 1.8/0.3 | 2.7/0.3 | 0.06 | ○ | 75 | ○ | ○ | 31 | ○ | 3.5 |

The data shown in Table 3 revealed that the polyester fabrics according to the invention are fabrics which have such an excellent level of tear strength that can never have been realized by using extra-fine polyester multifilaments alone and which are excellent in downproofness, softness, down opening tendency and compactness.

INDUSTRIAL APPLICABILITY

In accordance with the invention, it is possible to obtain a polyester fabric light in weight and excellent in tear strength. The polyester fabric of the invention is a fabric excellent in warmth retention, waterproofness, compactness and downproofness and therefore can be suitably used as or in an umbrella cloth, a warmth retaining material and so forth.

The invention claimed is:

1. A bag made of a downproof fabric, said fabric consisting essentially of:

a polyester fabric having a total cover factor of not lower than 1600 and a mass per unit area of not higher than 45 g/m$^2$, the fabric having been treated by calendering, wherein said polyester fabric is composed of polyester multifilament A yarns having a total fineness of not higher than 25 dtex and a single yarn fineness of not higher than 2.0 dtex and multifilament B yarns having a total fineness of not lower than 35 dtex, wherein the multifilament B yarn comprises polyester multifilaments and/or polyamide multifilaments, wherein the arrangements of the respective yarns in the warp and weft directions are such that the yarn constitution ratio "B yarn/A yarn" is ¼ to 1/20, and wherein there are 4 to 20 A yarns and then 1 B yarn, and the distance between the B yarns is not longer than 7 mm.

2. The bag according to claim 1, wherein the B yarns are paralleled yarns.

3. The bag according to claim 1, wherein the polyester fabric has a tear strength of not lower than 7 N in each of the warp and weft directions and an air permeability of not higher than 1.2 cc/cm$^2$/sec.

4. A warmth retaining material which comprises the bag according to claim 1 and a warmth retaining mass packed in said bag.

5. The bag according to claim 2, wherein the polyester fabric has a tear strength of not lower than 7 N in each of the warp and weft directions and an air permeability of not higher than 1.2 cc/cm$^2$/sec.

6. A warmth retaining material which comprises the bag according to claim 2 and a warmth retaining mass packed in said bag.

7. The bag according to claim 1, wherein the polyester fabric has a thickness of 0.065 mm or less.

8. The bag according to claim 1, wherein said calendaring fills interstitial spaces in the fabric.

9. The bag according to claim 1, wherein the fabric has a softness parameter of at least 70 mm, according to test method JIS L 1096 Bending resistance testing 6.19.4 Method D.

10. The bag according to claim 1, wherein the fabric is treated by at least one step selected from the group consisting of scouring, waterproofing, air impermeability imparting, and dyeing.

* * * * *